US011732471B2

(12) United States Patent
Headley

(10) Patent No.: US 11,732,471 B2
(45) Date of Patent: Aug. 22, 2023

(54) APPARATUS AND SYSTEM FOR ACOUSTIC CURVED CEILING BAFFLE AND METHODS OF MANUFACTURING THEREOF

(71) Applicant: TURF DESIGN, INC., Elgin, IL (US)

(72) Inventor: Dustin Headley, Hoffman Estates, IL (US)

(73) Assignee: TURF DESIGN, INC., Gilberts, IL (US)

( * ) Notice: Subject to any disclaimer, the term of this patent is extended or adjusted under 35 U.S.C. 154(b) by 0 days.

(21) Appl. No.: 16/997,561

(22) Filed: Aug. 19, 2020

(65) Prior Publication Data

US 2021/0054620 A1 Feb. 25, 2021

Related U.S. Application Data

(60) Provisional application No. 62/888,593, filed on Aug. 19, 2019.

(51) Int. Cl.
*E04B 1/84* (2006.01)
*E04B 1/99* (2006.01)

(52) U.S. Cl.
CPC ..... *E04B 1/99* (2013.01); *E04B 2001/8414* (2013.01); *E04B 2103/04* (2013.01)

(58) Field of Classification Search
CPC ..... E04B 1/86; E04B 1/99; E04B 1/18209; E04B 1/8404; E04B 1/8409; E04B 2001/8263; E04B 2001/8414; E04B 2001/8476; E04B 9/001
USPC ..... 52/144
See application file for complete search history.

(56) References Cited

U.S. PATENT DOCUMENTS

| | | | | |
|---|---|---|---|---|
| 2,542,428 | A * | 2/1951 | Peik | E04B 1/86 181/290 |
| 4,471,596 | A * | 9/1984 | Deaton | F21V 11/06 362/319 |
| 5,009,043 | A * | 4/1991 | Kurrasch | E04B 1/8227 181/290 |
| 6,305,492 | B1 * | 10/2001 | Oleiko | E01F 8/0017 181/210 |
| 8,782,987 | B2 | 7/2014 | Kabatsi et al. | |
| 9,779,715 | B1 * | 10/2017 | Seldal | G10K 11/162 |
| 10,094,108 | B2 * | 10/2018 | Murao | E04B 9/0428 |
| 10,508,444 | B2 | 12/2019 | Gillette et al. | |
| 10,584,488 | B2 | 3/2020 | Gillette et al. | |
| 11,434,636 | B2 | 9/2022 | Headley et al. | |
| 2005/0011150 | A1 | 1/2005 | Stackenwalt et al. | |
| 2006/0166581 | A1 * | 7/2006 | Huang | E04B 1/74 442/181 |
| 2013/0251935 | A1 * | 9/2013 | Day | B32B 5/24 428/71 |
| 2014/0224570 | A1 * | 8/2014 | Dupuy | G10K 11/28 181/175 |

(Continued)

*Primary Examiner* — Kyle J. Walraed-Sullivan
(74) *Attorney, Agent, or Firm* — Patzik, Frank & Samotny Ltd.

(57) ABSTRACT

An acoustic curved ceiling baffle and system that incorporates sidewalls with cuts or kerfs, top and bottom spines and ribs to properly configure the curves in the acoustic baffle, and that can be quickly and easily installed onto ceilings using integrated locks, cables or magnets, to produce a curved baffle system, and to provide an aesthetically pleasing image, along with a reduction in unwanted noise and/or room acoustics.

10 Claims, 6 Drawing Sheets

(56) References Cited

U.S. PATENT DOCUMENTS

| | | | | |
|---|---|---|---|---|
| 2014/0262607 | A1* | 9/2014 | Gray | E04B 1/84 181/290 |
| 2016/0138259 | A1* | 5/2016 | Hauptman | E04B 9/0407 52/80.2 |
| 2016/0281353 | A1* | 9/2016 | Gillette | G10K 11/162 |
| 2017/0044761 | A1* | 2/2017 | Flotre | G10K 11/162 |
| 2017/0107718 | A1* | 4/2017 | Sato | E04C 2/243 |
| 2018/0283004 | A1* | 10/2018 | Gillette | E04B 9/366 |
| 2018/0363558 | A1* | 12/2018 | Weaver | F02C 7/045 |
| 2019/0106883 | A1* | 4/2019 | Moore | E04B 9/366 |
| 2019/0127972 | A1* | 5/2019 | Mackett | E04B 1/86 |
| 2019/0292774 | A1* | 9/2019 | Durali | E04B 1/994 |
| 2022/0246125 | A1 | 8/2022 | Headley | |
| 2022/0246126 | A1 | 8/2022 | Headley | |
| 2022/0299977 | A1 | 9/2022 | Headley et al. | |

* cited by examiner

APPARATUS AND SYSTEM FOR ACOUSTIC CURVED CEILING BAFFLE AND METHODS OF MANUFACTURING THEREOF

A. TECHNICAL FIELD

The instant disclosure relates to acoustic curved ceiling baffles and systems, along with the methods for manufacturing and installing the acoustic curved ceiling baffles. In particular, the instant disclosure relates to an acoustic curved ceiling baffles and systems that incorporate cuts or kerfs to properly configure the curves in the acoustic baffle, and that can be quickly and easily installed onto construction ceiling hangers using integrated locks, cables or magnets, to produce a curved baffle system, and to provide an aesthetically pleasing image, along with a reduction in unwanted noise and/or room acoustics.

The instant disclosure further relates to an acoustic baffle and system configured using a program, such as a computer program that calculates the correct location of the kerfs in the sidewalls to optimize the predetermined curved baffle pattern or design. Once the sidewalls of the curved baffle are created and assembled along with the top and bottom shaped portions or sections, the assembly will then include an air gap for optimal acoustic properties. The top and bottom shaped portions may include ribs, stiffeners or struts to hold the sidewalls in place and in formation.

The instant disclosure further relates to an apparatus that is configured using recycled polyester felt or PET Felt, and in the preferred embodiment, including the sidewalls, top and bottom shaped portions and the struts. Additionally, the sidewalls may be covered by another layer of felt (or other material) to hide the kerfs incorporated to create the curved baffle.

Although felt or PET Felt is the preferred material due to acoustic, weight and environmental aspects, the instant disclosure can incorporate any material in the manufacture of the acoustic curved baffle, including plastic, wood, metal, etc. The acoustic curved baffle design can also incorporate numerous materials in the same design. For example, the sidewalls could be manufactured using PET Felt and the cover of the walls could be a thin layer of wood. Other possibilities exist for mixing materials.

B. BACKGROUND OF DISCLOSURE

In general terms, ceilings can be of two different types, suspended or exposed. Suspended ceilings are usually hung at a distance below the structural members to hide mechanical and electrical equipment, along with electrical conduit, HVAC ducts, water pipes, sewage lines, lighting fixtures, and similar structures. In order to construct a suspended ceiling, a metal grid is suspended from the actual ceiling, usually by wires, and acoustical or similar tiles, are inserted and supported by the grid.

However, for either cost or design purposes, many designs provide that the mechanical and electrical equipment are to be seen and not hidden. In these designs, there is no dropped ceiling and the ceiling is left to be viewed from the floor. Although the exposed ceiling may be a function of the design appeal, quite often an exposed ceiling creates acoustic problems, especially in large industrial rooms. Sound from one area of the room, can be reflected off the ceiling and be heard in other areas of the room. If there are a lot of workers or machinery, the room can become quite loud.

In order to minimize excessive and/or unwanted sound generated because of the exposed ceiling, one solution is to hang baffles from the ceiling at certain intervals to allow for the exposed ceiling to be viewed, but to reduce the acoustic profile. As an example of a structure intended to reduce unwanted noise is the Apparatus And System For Dynamic Acoustic Locking Ceiling System And Methods Thereof disclosed and claimed in U.S. Pat. No. 10,584,488 to Gillette et al., which discloses a dynamic acoustic locking ceiling baffle and a dynamic acoustic locking ceiling system, that includes a single piece of material folded into acoustic locking ceiling baffles, using locking pieces and locking mechanisms, to quickly and easily install the acoustic locking ceiling baffle onto construction ceiling hangers to provide an aesthetically pleasing image, along with a reduction in unwanted noise or room acoustics.

Another example is the Ceiling Baffle Apparatus And Ceiling Baffle System For A Dynamic Acoustic Ceiling And Methods Thereof disclosed and claimed in U.S. Pat. No. 10,508,444 to Gillette et al., which discloses a dynamic acoustic ceiling baffle and a dynamic acoustic ceiling baffle system, that includes multiple shaped baffles that can be quickly and easily installed onto construction ceiling hangers without the need for additional tools, to provide an aesthetically pleasing image, such as an undulating image, along with a reduction in unwanted noise or room acoustics.

Yet another example is the Supported Architectural Structure disclosed and claimed in U.S. Pat. No. 8,782,987, to Kabatsi et al., which discloses a plurality of primary supports configured to couple with one or more architectural structures, and a plurality of flexible fins is incorporated into the structure using primary supports, secondary supports and attachment points.

Another example of a ceiling structure is the Clipped Decorative Structure, U.S. patent application Ser. No. 10/774,233, to Stackenwalt et al., which discloses a decorative structure, which may be curved, suspended within a space and which includes a panel fastened to a support structure by a clip, a portion of which extends along a face of the panel.

These examples utilize additional supports, attachment hardware and clips to assist in suspending the flexible fins or decorative panels to the ceiling or to ceiling structure. In doing so, each of these examples necessitate tools to assemble the structure and to suspend the structure to the ceiling or ceiling support structure.

As such, there is a need for an acoustic ceiling baffles and systems that include curved baffles that look solid, but have an air core or are hollow to provide beneficial acoustic properties. There is a need for methods to facilitate in the design and manufacture of these curved baffles. There is also a need for these baffles and systems to be configured to be quickly and easily installed onto existing construction ceiling hangers or support structures, in many cases, without the need for tools, separate attachment devices, clips or the like. There is also a need for an acoustic curved ceiling system that is an aesthetically pleasing image, and that reduces unwanted noise or room acoustics.

The foregoing is intended only to illustrate the present technical field and background art and should not be taken as a limitation or disavowal of claim scope.

BRIEF SUMMARY

The present disclosure is an improved acoustic curved ceiling baffle apparatus, system and methods that utilizes kerfs in the sidewalls to facilitate the creation of the curvature of the sidewalls into the desired curved shape. The curved base sides are configured to be quickly and easily installed onto construction ceiling hangers using either integrated locks, cables or magnets (or a combination of these methods), to produce a curved baffle system, and to provide an aesthetically pleasing image, along with a reduction in unwanted noise and/or room acoustics. The installation methods are described in detail in U.S. Pat. No. 10,508,444, incorporated by reference herein.

The instant disclosure further relates to a program, such as a computer program used to create the acoustic curved baffle designs. The system uses a computer program that determines or calculates the location of the kerfs in the sidewalls to optimize the predetermined curved baffle pattern or design. The computer program can determine where the kerfs should be located in the sidewalls to allow the material to curve either in a concave or convex direction. The computer program can also determine the size of the particular kerfs depending on the radius of curvature of the sidewalls, or if there is no need for a kerf, such as a straight section of the sidewall. Additionally and for structural support, the computer program can determine where a strut will be located on the top or bottom portion or spine, and provide for a cut away of the sidewall at the proper location and in the correct direction, as the strut may intersect the sidewall at a curved portion.

In use, the computer program can accept a curved design input as understood by one having ordinary skill in the art, possibly from the information pertaining to the top and/or bottom shaped spine, or from a CAD drawing. The top and bottom shaped spines may include ribs, stiffeners or struts to hold the sidewalls in place and in formation. If so, the information provided to the computer program may also include where the struts or ribs of the spine will be located. Using that information, the computer program can calculate or determine the specific and optimal location and size of the kerfs necessary to be cut into the sidewalls to facilitate the design, creation and/or manufacture of the sidewalls of the curved baffle. The computer program can also calculate where the struts will intersect the sidewalls (and the direction of intersection) and provide for cut out of the material at those locations.

Once the computer program has determined where the kerfs and the strut cutouts are to be located on the sidewalls and the correct kerf sizes for proper curvature, a computer numeric control or CNC machine can cut the kerfs out of the material to create the sidewalls. The CNC machine can also cut out the material for the struts to be located.

Once the sidewalls of the curved baffle with the kerfs and cutouts are created along with the top and bottom spines or shaped portions, the curved baffle can be assembled. The sidewalls will easily curve at the kerfs and fit into the struts of the top and bottom spines. The curved baffle assembly will then include an air gap for optimal acoustic properties. The top side and bottom side further keep the two base sides a distance apart to create the air gap, which contributes to the beneficial acoustic properties.

Once the sidewalls and top and bottom spines are assembled together, the curved baffle can be finished for a desired look and for installation purposes. For example, the sidewalls and the top and bottom spines can be covered with a similar but thinner material to make the entire curved baffle monochromatic. Additionally, installation hardware can be installed to allow the curved baffle to be installed onto the ceiling structure. For example, cable connectors can be installed into the top spine so that the curved baffle can be attached to hanging cables at the installation site.

The instant disclosure further relates to an apparatus that is configured using recyclable or recycled polyester felt or PET Felt, in the preferred embodiment, including the sidewalls, top and bottom shaped portions and the ribs or struts. Again, the sidewalls may be covered by another layer of felt to hide the kerfs incorporated to create the curved baffle. In the preferred embodiment, PET Felt having a thickness of nine (9) millimeters is used for the sidewalls, top and bottom portions, and the struts or ribs. Additionally, PET Felt having a thickness of three (3) millimeters is used for the material covering the sidewalls and the bottom and top portions to give the end product a finished look.

Although felt or PET Felt is the preferred material due to acoustic, weight and environmental aspects, any material can be used to manufacture the acoustic curved baffle of the present invention, including plastic, wood, metal, etc. The acoustic curved baffle design can also incorporate numerous materials in the same design. For example, the sidewalls could be manufactured using PET Felt and the cover of the walls could be a thin layer of wood. Other possibilities exist for mixing materials.

It is thus an objective of the present disclosure to provide an improved acoustic curved baffle, comprising sidewalls with kerfs for facilitating the curvature of the baffle sides, along with a top and bottom spines containing ribs to facilitate the assembly of the baffle. An objective of the present disclosure further provides for the sidewalls and the top and bottom spines to be covered using a thin veneer, laminate or material to improve the visual characteristics of the baffle. Additionally, an objective of the present disclosure provides for installation hardware to be attached to the curved baffle to facilitate installation onto existing ceiling structures without the need for tools, clips or additional attachment devices.

Another objective of the present disclosure is to include multiple curved baffles located on or in a ceiling structure to create a curved baffle system as a ceiling structure, maintaining the objective of installing the system of curved baffles onto existing ceiling structures without the need for tools, clips or additional attachment devices.

It is yet another objective of the present disclosure to provide a computer program for calculating and determining the placement or location of the kerfs and cutouts in the sidewalls and the shape of the top and bottom spines based on the curved baffle design. Once determined, it is an objective of the present disclosure to provide instructions to a CNC machine for cutting out the sidewalls, top and bottom spines and the ribs, along with the kerfs properly located on the sidewalls for the particular curved design.

Additional objectives and advantages of the present disclosure will become apparent to one having ordinary skill in the art after reading the specification in light of the drawing figures, however, the spirit and scope of the present invention should not be limited to the description of the embodiments contained herein.

DETAILED DESCRIPTION

As stated herein, the objective of the present disclosure is to provide an improved acoustic curved ceiling baffle, and an improved acoustic curved ceiling system, along with improved methods for designing, manufacturing and/or installing the curved ceiling baffle apparatus and creating and installing the acoustic curved ceiling system.

Figure 1:
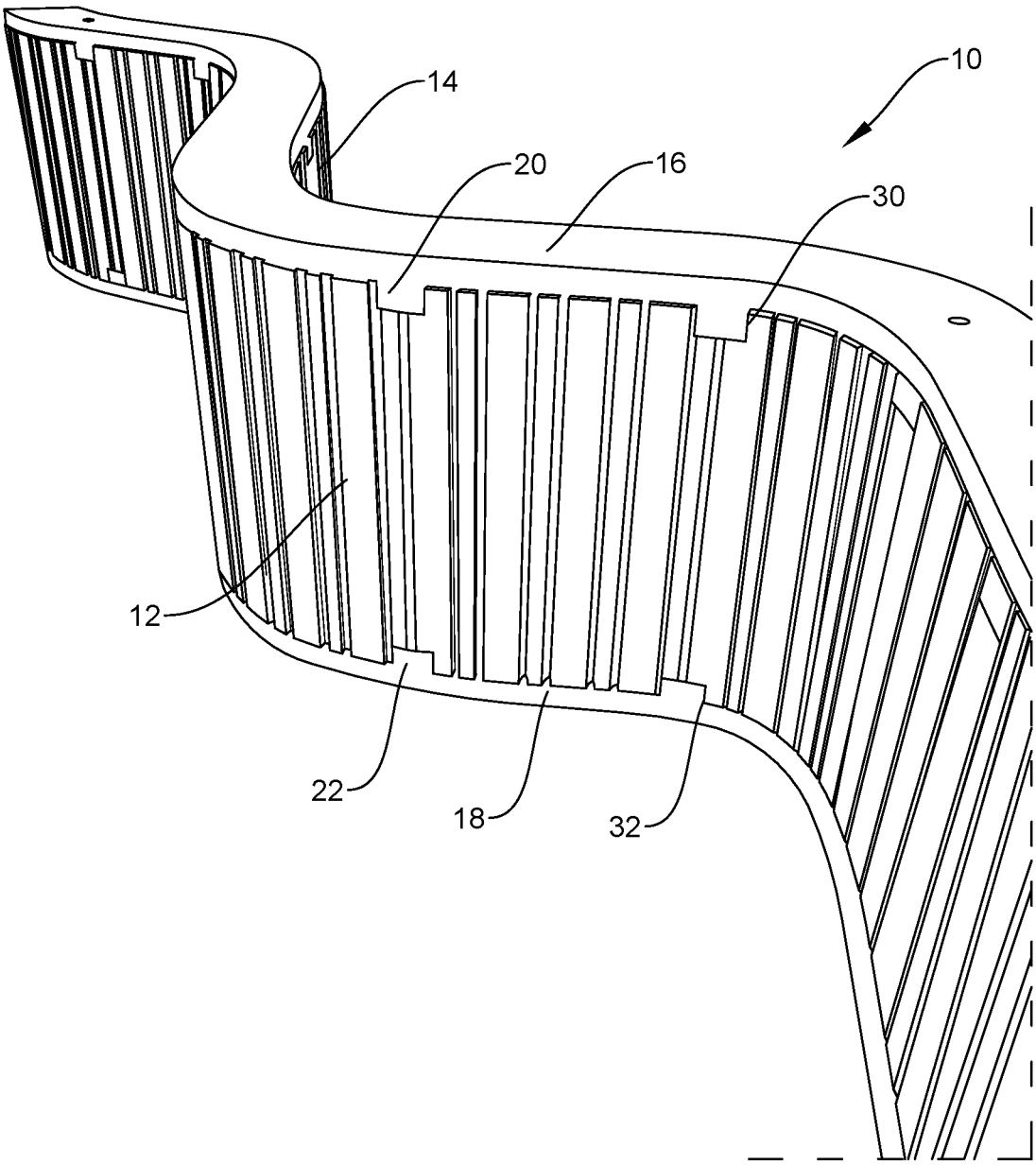
FIG. 1 is a perspective view of an acoustic curved ceiling baffle in accordance with the present disclosure.

Referring to the drawings, wherein like reference numerals refer to the same or similar features in the various views, FIGS. 1 through 8 show different views of the improved curved baffle apparatus 10. FIG. 1 shows the resulting curved baffle apparatus 10 after the first sidewall 12 and second sidewall 14 are assembled with the top spine 16 and bottom spine 18. The top spine 16 contains one or more top spine struts or ribs 20, and the bottom spine 18 comprises one or more bottom spine struts or ribs 22. The top spine strut 20 and bottom spine strut 22 are used in conjunction with the top spine 16 and bottom spine 18 to hold the first sidewall 12 and second sidewall 14 in place in their curvilinear or curved position. This assembly creates an air gap 24 (see FIG. 3), which creates the acoustic curved baffle of the present invention.

The curved baffle apparatus 10, which is made in the preferred embodiment, from sheets of nine (9) millimeter polyester felt or PET Felt, is intended to be assembled into a curvilinear shape, approximately 8.25 inches high and 2.0 inches thick with an air gap of 1.06 inches. Of course, varying lengths, heights and depths are possible depending on the curvature design. Curved baffles as large as ten feet long and four feet high (or larger) can be incorporated using the functionality described herein. PET Felt is used in the preferred embodiment due to its beneficial acoustic, weight and environmental properties.

However, almost any material can be used to produce the first sidewall 12 and second sidewall 14, top spine 16 and bottom spine 18, and top spine strut 20 and bottom spine strut 22. Thus, the acoustic curved baffle of the present invention can be manufactured out of plastic, wood, metal, and other materials. Additionally, the acoustic curved baffle design can incorporate different materials in the same design, such as first sidewall 12 and second sidewall 14 of PET Felt, top spine 16 and bottom spine 18 made of wood and top spine strut 20 and bottom spine strut 22 made of plastic, as an example. Other possibilities exist for mixing materials.

Figure 2:
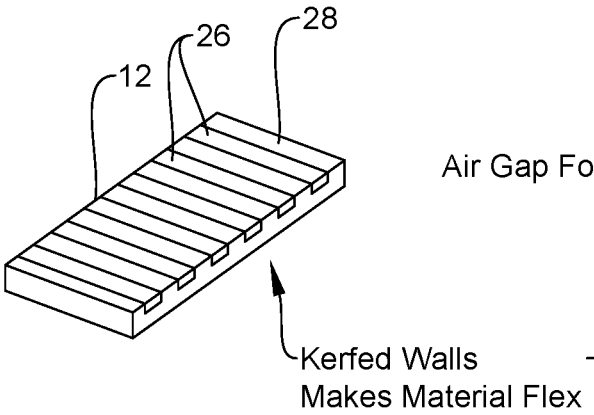
FIG. 2 is a perspective view of a sidewall of an acoustic curved ceiling baffle after kerfs before curvature of the sidewall in accordance with the present disclosure.

FIG. 2 shows the first sidewall 12 in its flat position before it is assembled in its curved position. The sidewall 12 has been modified to include kerfs or cuts 26 in a first side 28 of the sidewall 12, and a second side 29 of the sidewall 12. The kerfs 26 can be straight 26*a* creating square or rectangular cuts into the first side 28 of the sidewall 12. Additionally, the kerfs 26 can be angled 26*b* creating an upside down triangle cuts into the first side 28 of the sidewall 12.

Either way, the kerfs 26 configured in the sidewall 12 facilitate the flex or curvature of the sidewall 12 in either the concave or the convex direction, and are not visible from the second side 29 of the sidewall 12. The kerfs 26 can be the same size, or different sizes, as different size kerfs 26 will allow for smaller diameter curves. Also, to the extent the curved baffle apparatus 10 design is straight in a section of the baffle apparatus 10, there may not be a need for a kerf 26 to be cut into the sidewall 12 at that location. Additionally, although not necessary, instead of being located only on the first side 28 of the sidewall 12, the kerfs 26 can be located on both the first side 28 and the second side 29, of the first sidewall 12 and/or second sidewall 14.

Figure 3:
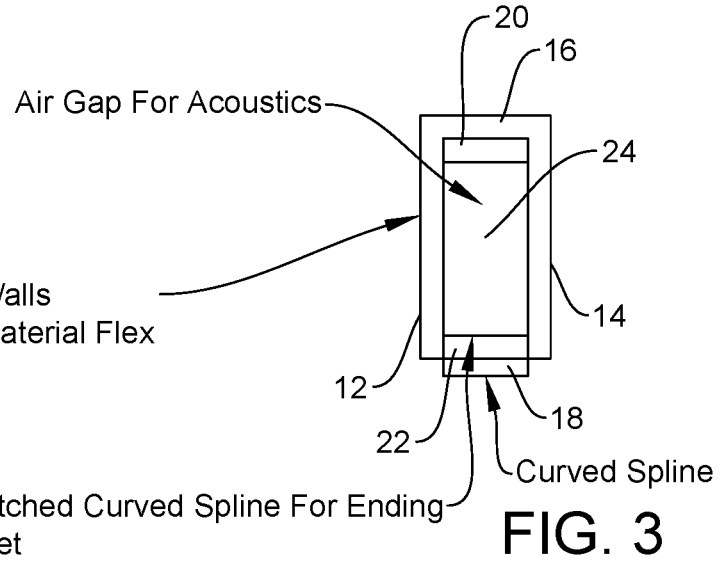
FIG. 3 is a side view of an acoustic curved ceiling baffle in accordance with the present disclosure.

FIG. 3 shows a side view of a cut away from the middle of the curved baffle apparatus 10. The cutaway shows the first sidewall 12 and second sidewall 14, after being assembled with the top spine 16 and bottom spine 18. The top spine struts 20 and the bottom spine struts 22 fit into the top cut outs 30 and bottom cut outs 32, respectively, as shown in FIG. 1. The top spine strut 20 and bottom spine strut 22 assist in securing the first sidewall 12 and second sidewall 14 in place in their curved position. The air gap 24 creates the acoustic properties of the curved baffle.

Figure 4:
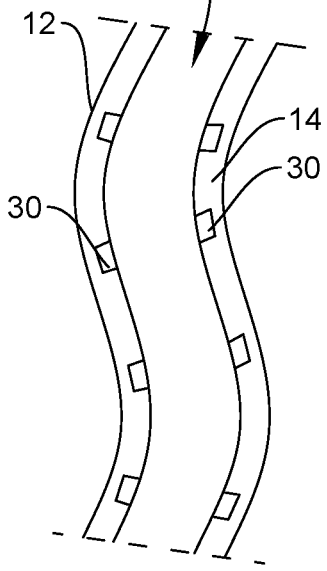
FIG. 4 is a top view of an acoustic curved ceiling baffle without the top spine in accordance with the present disclosure.

FIG. 4 shows a top view of the acoustic curved baffle apparatus 10 without the top spine 16, which includes the first sidewall 12 and the second sidewall 14 along with the top cutouts 30 in the first sidewall 12 and second sidewall 14 that are used to receive or guide the top spine 16 struts 20. When the struts or ribs 20 of the top spine 16 are inserted into the top cutouts 30, the first sidewall 12 and second sidewall 14 will maintain their curved shape. Maintaining the curved shape is also helped by the insertion of the struts or ribs 22 of the bottom spine 18 into the bottom cutouts 32 of the first sidewall 12 and second sidewall 14 (see FIG. 1).

Figure 5:
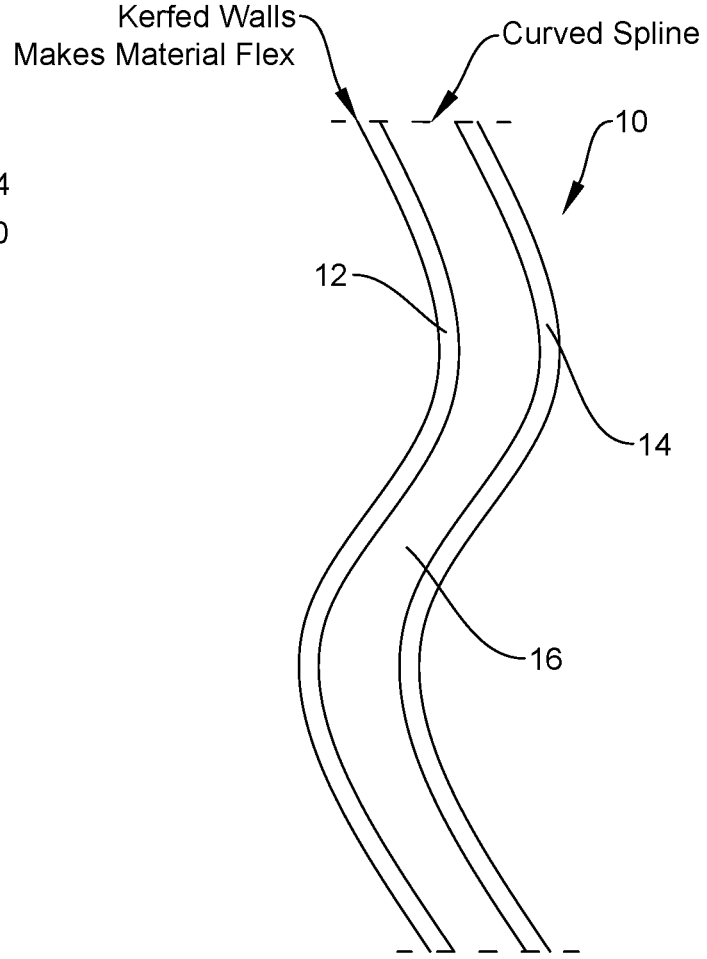
FIG. 5 is a top view of an acoustic curved ceiling baffle in accordance with the present disclosure.

Once the struts 20 of the top spine 16 are inserted into the top cutouts 30 of the first sidewall 12 and second sidewall 14, the curved baffle will maintain its shape. FIG. 5 shows a top view of the acoustic curved baffle apparatus 10 with the curved top spine 16 placed over the first sidewall 12 and the second sidewall 14.

Figure 6:
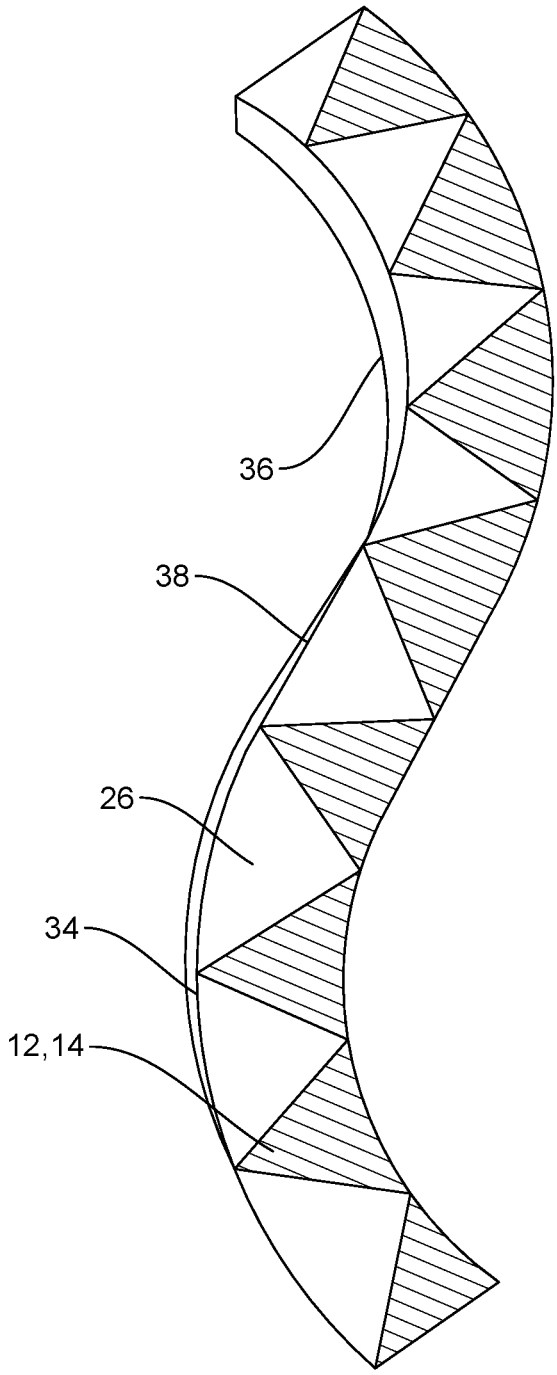
FIG. 6 is a top view of a sidewall of an acoustic curved ceiling baffle after kerfs after curvature of the sidewall in accordance with the present disclosure.

FIG. 6 is a top view of a first sidewall 12 and second sidewall 14 of the acoustic curved baffle apparatus 10, either the first sidewall 12 or the second sidewall 14, after kerfs 26 have been cut into the first sidewall 12 and second sidewall 14 and after curvature of the first sidewall 12 and second sidewall 14. In this example, the kerfs 26 are triangular 26*b* in shape. As described herein, other shapes can be utilized. In the FIG. 6 example, the first sidewall 12 and second sidewall 14 are able to curve in both convex 34 and concave 36 patterns from the front side 28 of the first sidewall 12 and second sidewall 14. Depending on the size and location of the kerfs 26, the curvature can be a smaller sharp radius or a larger more gradual radius.

To the extent that the design calls for covering up the kerfs 26 on the first sidewall 12 and second sidewall 14, to create a smoother outer surface, a layer of material 38 can be installed or attached to the front side 28 of the first sidewall 12 and second sidewall 14. Again, this can be almost any material, such as wood, plastic or metal, but in the preferred embodiment, a three (3) millimeter thick PET Felt piece 38 is attached to the front side 28 of the first sidewall 12 and second sidewall 14. Other sizes and materials can be used for the device cover.

Figure 7:
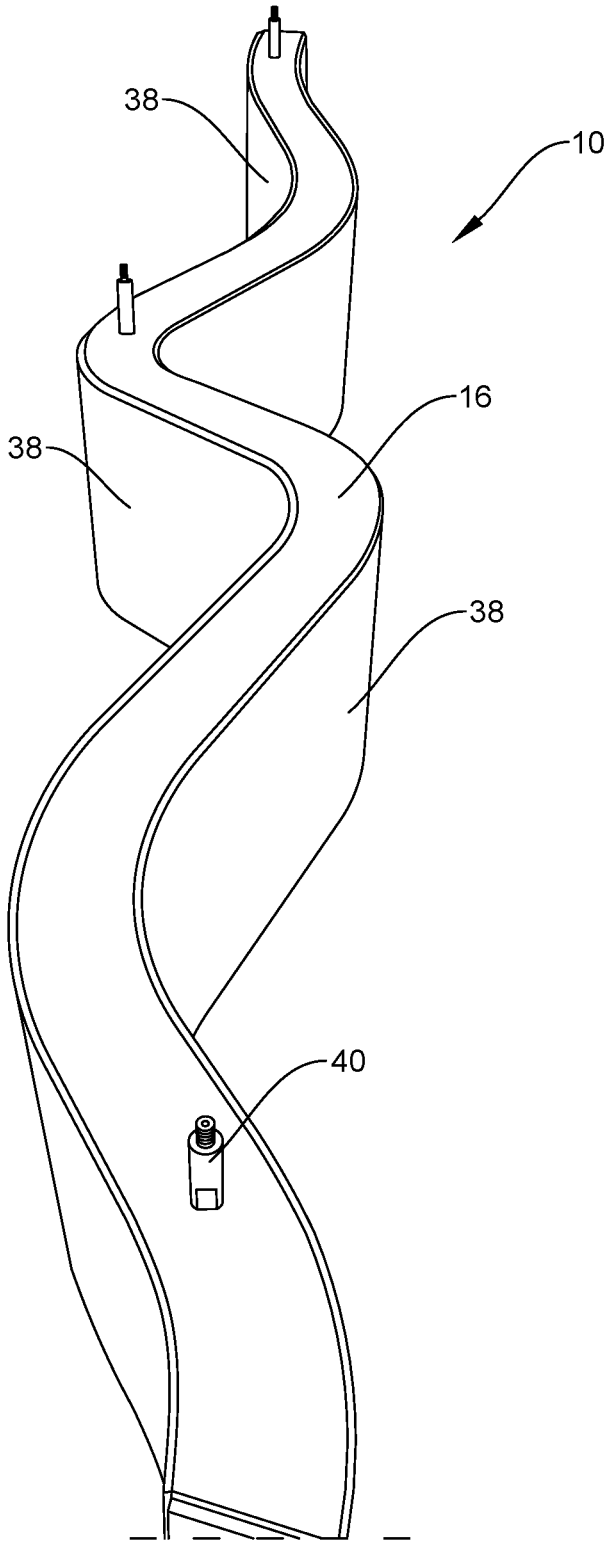
FIG. 7 is a perspective view of an acoustic curved ceiling baffle in accordance with the present disclosure.
Figure 8:
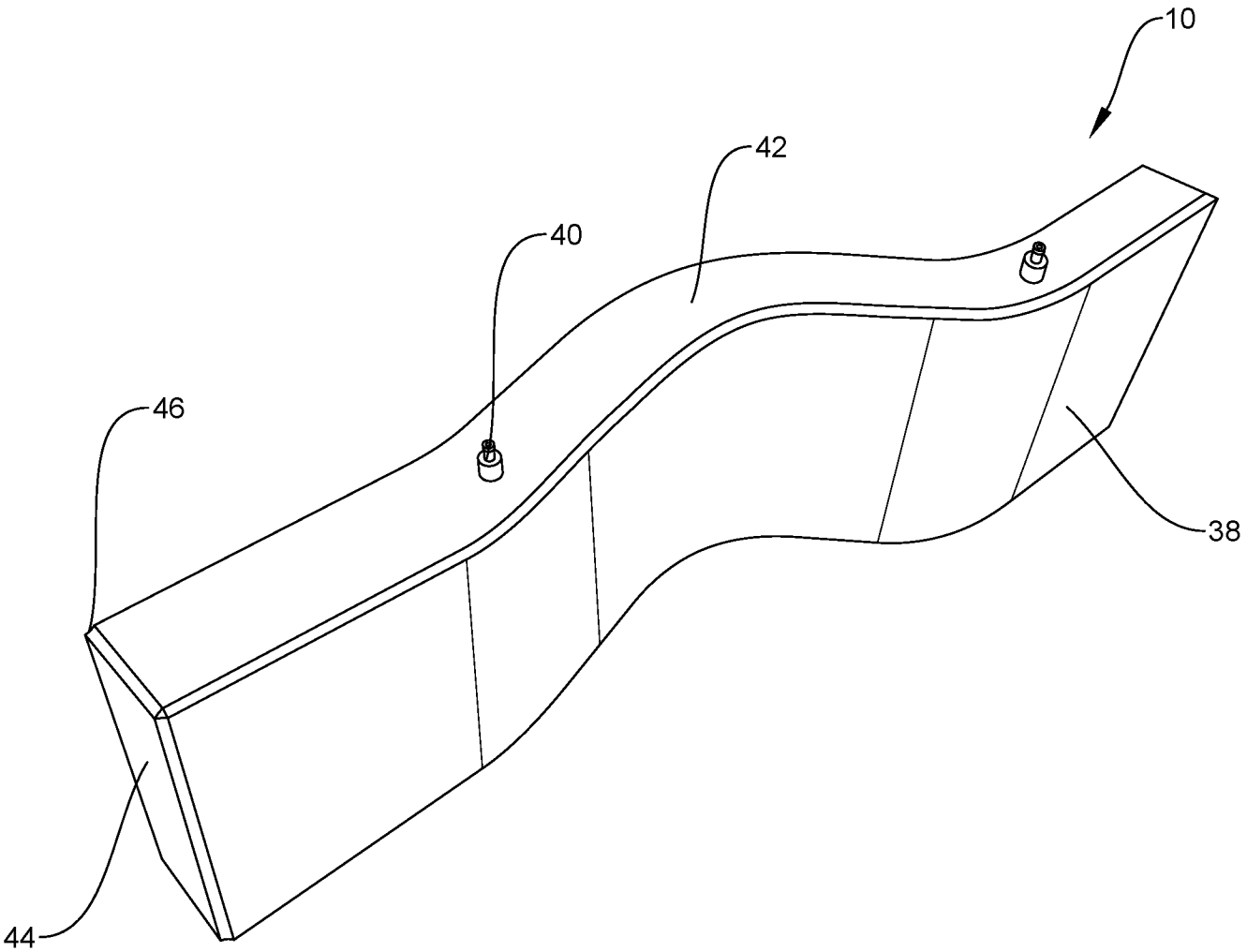
FIG. 8 is a perspective view of an acoustic curved ceiling baffle in accordance with the present disclosure.

FIGS. 7 and 8 show the acoustic curved ceiling baffle apparatus 10 after being assembled in the curved position of the intended design. FIG. 7 shows the top spine 16 and the first sidewall 12 and second sidewall 14, which are concealed by a sidewall cover 38. The installation hardware 40 is included to allow the installation of the curved baffle apparatus 10 onto a ceiling system (not shown). In FIGS. 7 and 8, the installation hardware will be attached to cables hanging from the ceiling. FIG. 8, like FIG. 7, includes a sidewall cover 38 over the first sidewall 12 and second sidewall 14, but also includes a top cover 42 over the top spine portion 16. Additionally, FIG. 8 shows end covers 44 that are located at the ends 46 of the acoustic curved baffle apparatus 10. Further, a bottom cover (not shown) can be used to cover the bottom spine portion 18. These covers 38, 42, 44 provide a streamlined, monochromatic vision, although any type of cover 38, 42, 44 and color can be achieved.

Numerous ceiling baffle shapes and designs can be constructed in accordance with the present disclosure. The curved portions 12, 14 that will be assembled to make the curved baffle apparatus 10 can use almost any concave or convex design imaginable. The top 16 and bottom 18 spines will then be created along with the top spine strut 20 and bottom spine strut 22 so that the curved baffle apparatus 10 can be assembled accordingly.

By using a program, such as a computer program, as detailed below, the proper kerf 26 size and location can be calculated to be carved out in the first sidewall 12 and second sidewall 14, along with the top spine 16 and bottom spine 18 and the top spine strut 20 and bottom spine strut 22. Once all the pieces are known and/or calculated, the computer program can determine the optimal cut design thereby reducing material waste. Once the computer program is converted for use with a CNC machine, the CNC machine can cut each of the pieces necessary for the curved baffle apparatus 10. As such, using the computer program and a CNC machine, a user can design a baffle and have the structural pieces cut out in a very short time.

As described herein, the material used in the preferred embodiment is polyester felt and is between 60% and 99% recycled material. The walls of the acoustic curved ceiling baffles 10 in the preferred embodiment are 9 mm thick, and the panel thickness (after assembly) is 2.0 inches thick, with an air gap of 1.06 inches, however, other sizes are possible. Maintenance includes occasional vacuuming to remove particulate matter and air-borne debris or dust. Compressed air can be used to dust off the material in difficult to reach areas and for large assemblies.

The felt comes in numerous colors, including white, cream, light grey, light brown, brown, matte grey, charcoal, black, yellow, mango, orange, red, lavender, lime, green, light blue and dark blue. Of course, the curved ceiling baffles 10 can be manufactured in many other colors and the present disclosure is not limited to these specifications and colors, as these are merely the specifications and colors for the preferred embodiments and alternative embodiments.

Figure 9:
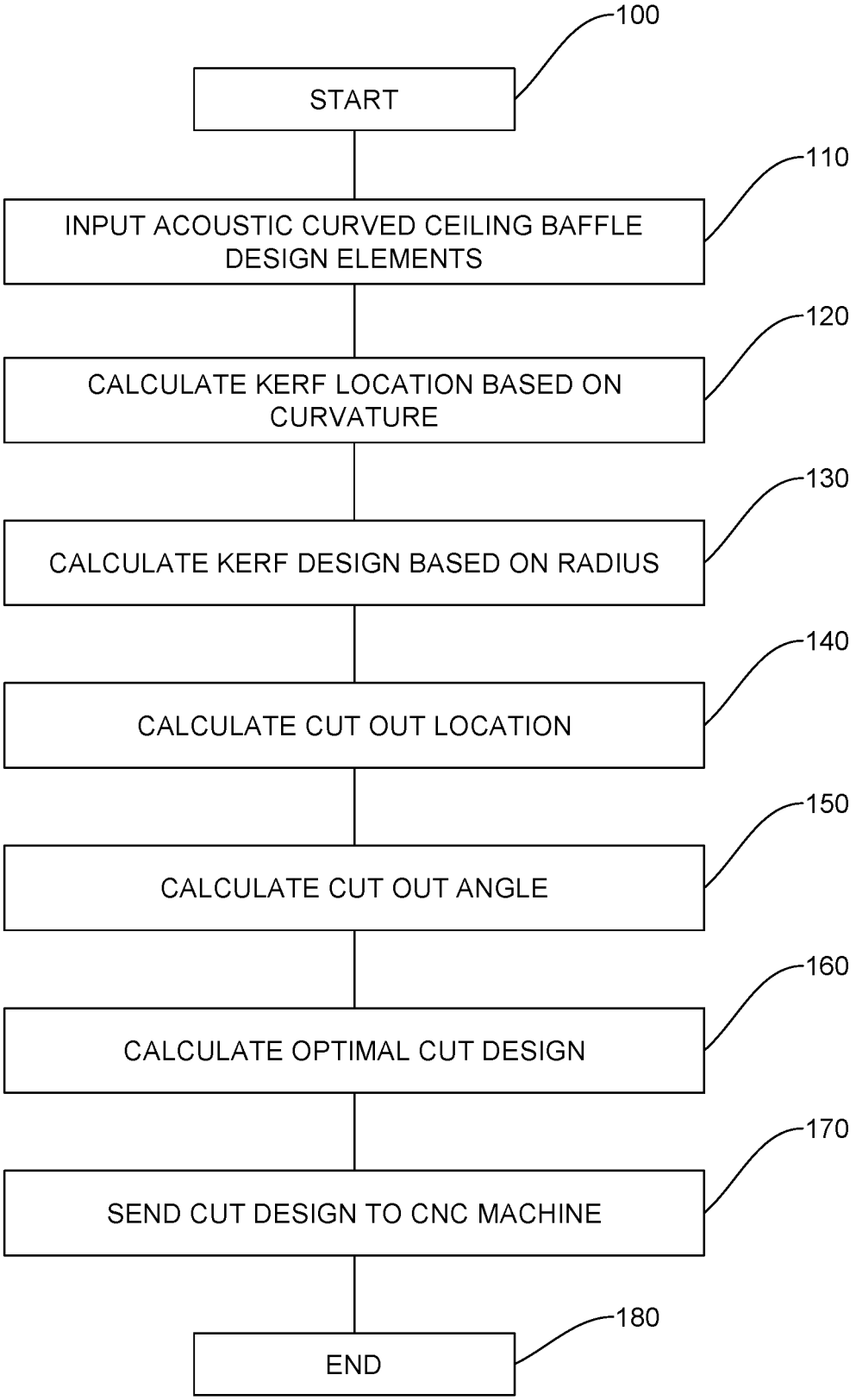
FIG. 9 is a flow chart of the computer program to calculate the kerfs and cut outs for the sidewalls in accordance with the present disclosure.

An alternative embodiment for installing the curved baffle apparatus 10 includes using installation hardware 40, such as magnets (not shown) embedded into the curved baffle apparatus 10 so that when the curved baffle apparatus 10 is assembled, the embedded magnets will hold the curved baffle apparatus 10 to a standard ceiling structure (not shown) or to any metal material. Other installation hardware and techniques are disclosed in detail in U.S. Pat. No. 10,508,444, incorporated by reference herein FIG. 9 shows a flow chart of the computer program used to calculate the kerfs and cut outs for the sidewalls, along with the information for all pieces as sent to a CNC machine for optimal cutting and scoring. The computer program starts at step 100, which is the same for all programming functions. At step 110, the acoustic curved ceiling baffle apparatus 10 is designed and/or entered into the computer system. This can be done in a number of ways as understood by one having ordinary skill in the art, including providing CAD/CAM software so that the user can design a curved baffle apparatus 10, or if the curved baffle apparatus 10 has already been designed, entering the design information into the system for calculations and determinations.

Once the curved baffle apparatus 10 design has been generated and/or entered into the computer system, the system calculates the kerf 26 locations in step 120. These kerf 26 locations will be based on the baffle apparatus 10 design and the curvature of the design. Along those lines, at step 130, the computer program will calculate or determine the size of the individual kerfs 26. For example, if the curvature is a very tight or small radius, the computer program may us larger kerfs 26 and closer together, to allow a small radius curve. If the radius is large, the first sidewall 12 and second sidewall 14 may only need a couple, smaller kerfs 26 to obtain the correct radius of curvature.

Once the kerf 26 determination has been completed, the computer program can calculate the cut out angles and locations for the top cutouts 30 and the bottom cutouts 32 in the first sidewall 12 and second sidewall 14 for the top spine strut 20 and bottom spine strut 22 to be inserted. The top spine strut 20 and bottom spine strut 22 will secure the top spines 16 and bottom spines 18 to the first sidewall 12 and second sidewall 14. This includes step 140, determining the location, and step 150, determining the cut out angle, which may not be perpendicular to the direction of the first sidewall 12 and second sidewall 14, if the top spine strut 20 and bottom spine strut 22 intersect the first sidewall 12 and second sidewall 14 at a curve.

Once all of the piece shapes have been determined from the curved baffle apparatus 10 design, the computer program can optimize a cutting and scoring strategy at step 160 to minimize waste of the curved baffle apparatus 10 material. In doing so, the computer program will shift the different pieces into a location on a board so that the CNC machine will cut out the pieces with the least amount of waste. The computer program will take into account the particular design colors and thicknesses to determine the optimal cutting patterns.

Finally, at step 170, the computer program will send the information to the CNC machine for cutting out the pieces. The pieces include the first sidewall 12, the second sidewall 14, the top spine 16, the bottom spine 18, the multiple top spine strut 20 and bottom spine strut 22, and the covers 38, 42, 44, although the covers may be a thinner material to be cut from a different piece of material. Once the pieces are cut to size, the acoustic curved baffle apparatus 10 can be assembled. The computer program ends at step 180.

Reference throughout the specification to "various embodiments," "some embodiments," "one embodiment," or "an embodiment", or the like, means that a particular feature, structure, or characteristic described in connection with the embodiment is included in at least one embodiment. Thus, appearances of the phrases "in various embodiments," "in some embodiments," "in one embodiment," or "in an embodiment", or the like, in places throughout the specification are not necessarily all referring to the same embodiment.

Further, the particular features, structures, or characteristics may be combined in any suitable manner in one or more embodiments. Thus, the particular features, structures, or characteristics illustrated or described in connection with one embodiment may be combined, in whole or in part, with the features structures, or characteristics of one or more other embodiments without limitation given that such combination is not illogical or non-functional. Although numerous embodiments of this invention have been described above with a certain degree of particularity, those skilled in the art could make numerous alterations to the disclosed embodiments without departing from the spirit or scope of this disclosure.

All directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the any aspect of the disclosure.

As used herein, the phrased "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. A dynamic acoustic curved ceiling baffle, comprising:

a first sidewall, said first sidewall comprising at least one first sidewall kerf, said at least one first sidewall kerf facilitating the curvature of said first sidewall;

a second sidewall, said second sidewall comprising at least one second sidewall kerf, said at least one second sidewall kerf facilitating the curvature of said second sidewall;

a top spine, said top spine comprising at least one top spine strut, said at least one top spine strut used in conjunction with said top spine to hold the first sidewall and second sidewall in a curved position;

a bottom spine, said bottom spine comprising at least one bottom spine strut, said at least one bottom spine strut used in conjunction with said bottom spine to hold the first sidewall and second sidewall in said curved position;

wherein said first sidewall, said second sidewall and said top spine combine to create an air gap; and a first sidewall cover, said first sidewall cover located over one side of said first sidewall to hide the at least one first sidewall kerf;

at least one installation device being located on the top end of the dynamic acoustic curved ceiling baffle, said at least one installation device being integral with the dynamic acoustic curved ceiling baffle for attachment to a ceiling;

wherein, said first sidewall, said second sidewall, said top spine, and said at least one top spine strut all comprise PET Felt material.

2. The dynamic acoustic curved ceiling baffle of claim 1, wherein said first sidewall, second sidewall, said top spine, said at least one top spine strut, said bottom spine and said at least one bottom spine strut comprise PET Felt material, all of the foregoing having a thickness of 9 millimeters.

3. The dynamic acoustic curved ceiling baffle of claim 1, further comprising a second sidewall cover, said second sidewall cover located over one side of said second sidewall to hide the at least one second sidewall kerf.

4. The dynamic acoustic curved ceiling baffle of claim 3, wherein said first sidewall cover and said second sidewall cover comprise PET Felt material.

5. The dynamic acoustic curved ceiling baffle of claim 4, wherein said first sidewall cover and said second sidewall cover comprise PET Felt material, all of the foregoing having a thickness of 3 millimeters.

6. The dynamic acoustic curved ceiling baffle of claim 4, wherein said at least one installation device comprises a double arrow design.

7. The dynamic acoustic curved ceiling baffle of claim 1, wherein said at least one installation device comprises PET Felt material.

8. The dynamic acoustic curved ceiling baffle of claim 1, wherein said at least one installation device comprises at least one magnet.

9. The dynamic acoustic curved ceiling baffle of claim 1, wherein said at least one installation device comprises at least one cable gripper.

10. The dynamic acoustic curved ceiling baffle of claim 1, wherein said at least one installation device comprises at least one panel clip.

* * * * *